US007913851B2

(12) United States Patent
Chang

(10) Patent No.: US 7,913,851 B2
(45) Date of Patent: Mar. 29, 2011

(54) SEPARATOR FOR GRINDING MILL

(76) Inventor: Jin-Hong Chang, Hsin Ying (TW)

( * ) Notice: Subject to any disclaimer, the term of this patent is extended or adjusted under 35 U.S.C. 154(b) by 0 days.

(21) Appl. No.: 12/409,939

(22) Filed: Mar. 24, 2009

(65) Prior Publication Data

US 2009/0178960 A1 Jul. 16, 2009

Related U.S. Application Data

(60) Continuation-in-part of application No. 11/292,967, filed on Dec. 1, 2005, now abandoned, which is a division of application No. 10/828,852, filed on Apr. 19, 2004, now Pat. No. 7,118,055.

(51) Int. Cl.
*B07B 7/00* (2006.01)
*B02C 13/26* (2006.01)

(52) U.S. Cl. ..... 209/139.2; 209/139.1; 209/710; 209/713; 241/79; 241/119

(58) Field of Classification Search ..... 209/28, 209/29, 138, 139.1, 139.2, 710, 713; 241/79, 241/80, 119
See application file for complete search history.

(56) References Cited

U.S. PATENT DOCUMENTS

| | | | | |
|---|---|---|---|---|
| 2,988,220 | A * | 6/1961 | Rezsoe | 209/714 |
| 3,770,124 | A * | 11/1973 | Frangquist | 209/139.2 |
| 4,296,864 | A * | 10/1981 | Misaka et al. | 209/135 |
| 4,799,595 | A * | 1/1989 | Binder | 209/135 |
| 5,238,196 | A * | 8/1993 | Chang | 241/56 |
| 5,938,045 | A * | 8/1999 | Makino et al. | 209/713 |
| 6,318,559 | B2 * | 11/2001 | Cordonnier et al. | 209/154 |
| 7,240,868 | B2 * | 7/2007 | Lin et al. | 241/79.1 |

* cited by examiner

*Primary Examiner* — Joseph C Rodriguez
(74) *Attorney, Agent, or Firm* — Pro-Techtor Int'l Services; Ralph Willgohs

(57) ABSTRACT

A separator is used in conjunction with a grinding mill which has a suction assembly, a grinding device, regulating devices and a driving device. The separator is mounted in a main body of the grinding mill on a rotating vertical separator shaft, comprising two support rings of equal sizes and shapes, mounted on the separator shaft with parallel orientations, having radial bridges with openings in between, which are surrounded by a plurality of mounting holes; and a plurality of blades, hingedly mounted on the mounting holes by vertical rods, for separating ground particles according to size.

11 Claims, 13 Drawing Sheets

SEPARATOR FOR GRINDING MILL

CROSS-REFERENCE TO RELATED APPLICATIONS

This application is a continuation-in-part application of U.S. patent application Ser. No. 11/292,967 filed on Dec. 1, 2005 now abandoned entitled "A Separator" which is a divisional application of U.S. patent application Ser. No. 10/828,852 filed on Apr. 19, 2004, now U.S. Pat. No. 7,118,055 B2 entitled "Grinding mill".

FIELD OF THE INVENTION

The present invention relates to a separator for use in a grinding mill, particularly to a separator for use in a vertically oriented grinding mill.

DESCRIPTION OF RELATED ART

With increasing quality of life, demands on industrial products have become stricter. In particular, food and medical products have become subjected to environmental standards. The GMP standard regulates grinding mills as to ingredients, noise, iron contents (resulting from wear), temperature, and pollution. So far, few grinding mills of those produced in all countries fulfill the GMP standard.

Conventionally, grinding mills are designed according to the following considerations: (1) torque, (2) centrifugal force, (3) grinding force, (4) heat, and (5) noise. Separators for grinding mills are designed for effectiveness of separating various particle sizes. These criteria are interconnected. However, conventional separators insufficiently separate desired line from yet too coarse particles.

In U.S. Pat. No. 5,238,196 "Upright lever pressure type mill", the present inventor has disclosed a grinding mill with a separator. As shown in FIGS. 11 and 12, a separator 80 has a shaft sleeve 81, into which a shaft 90 is inserted; two ring-shaped rotating plates 82, having a plurality of blades 83 that are radially oriented and placed on outer sides of the rotating plates 82; a casing 84, shaped like a cylinder, surrounding the plurality of blades 83; and a circular base plate 85, carrying the shaft sleeve 81.

During grinding, ground material is carried by an air flow, passing through the separator 80. Upon rotation of the shaft 90, due to a centrifugal force, relatively fine particles pass through a center of the separator 80, whereas relatively coarse particles are drawn to a periphery thereof. Since the blades 83 are taken along during the rotation of the shaft 90, the blades 83 prevent relatively coarse particles from passing through the separator 80, so that relatively coarse particles fall down and are ground again.

However, the separator shown in FIG. 11 still has the following shortcomings: The rotating plates 82 have concentric openings, allowing air carrying ground particles to pass through. However, radial fixing plates 86, used to connect the rotating plates 82 to the shaft sleeve 81 hinder free air flow and consequently a rising movement of ground particles, so that separation of relatively coarse from relatively fine particles is not performed effectively.

Furthermore, the blades 83 are mounted at a fixed vertical distance from the base plate 90, which has an influence on which ground particles are separated to be ground again. Since the vertical distance between the blades 83 and the base plate 85 cannot be regulated during operation, fineness of grinding cannot be controlled during operation.

Moreover, as shown in FIG. 12, the blades 83 are fixed on outer sides of the rotating plates 82, hence forces upon impact of larger clumps of grinding material are large, threatening to damage the blades 83.

Finally, due to the casing 84 surrounding the blades 83, particles hit by the blades are prevented from leaving the separator 80, interfering with the rising air flow rather than directly falling back to be ground again, so that total grinding time becomes longer.

Further separators have been disclosed in U.S. Pat. No. 6,318,559 and U.S. Pat. No. 3,372,805, which work as separate units for processing already ground particles, e.g., for separating and sieving, but are not suitable for operation in conjunction with mills.

Therefore, conventional separators for grinding mills are still in need of improvement.

SUMMARY OF THE INVENTION

The present invention is a separator used in conjunction with a grinding mill which has a suction assembly, a grinding device, regulating devices and a driving device. The separator is mounted in a main body of the grinding mill on a rotating vertical separator shaft, comprising two support rings of equal sizes and shapes, mounted on the separator shaft with parallel orientations, having radial bridges with openings in between, which are surrounded by a plurality of mounting holes; and a plurality of blades, hingedly mounted on the mounting holes by vertical rods, for separating ground particles according to size.

The present invention can be more fully understood by reference to the following description and accompanying drawings.

DETAILED DESCRIPTION OK THE PREFERRED EMBODIMENTS

Figure 1:
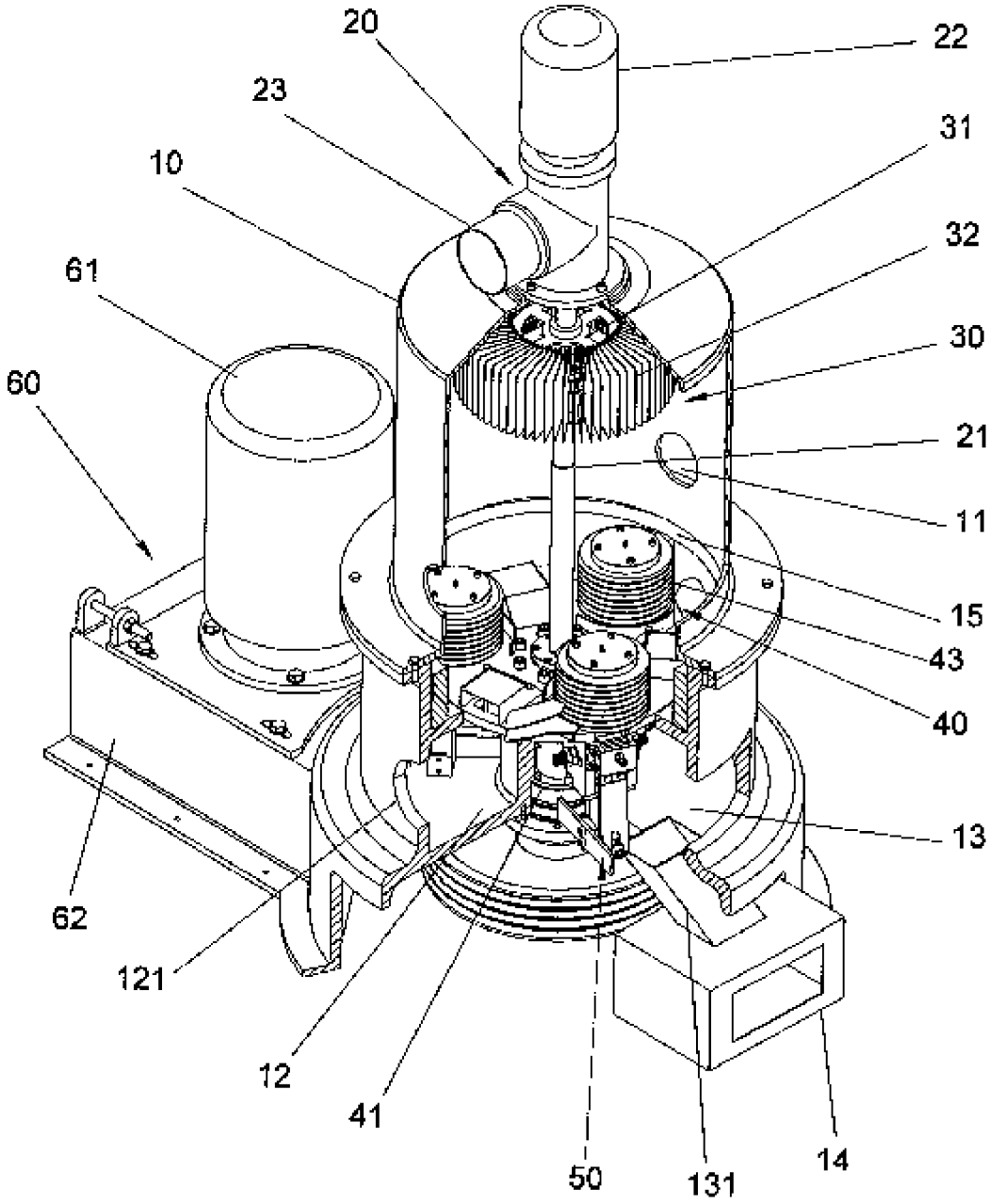
FIG. 1 is a partial sectional view of an embodiment of the grinding mill of the present invention.
Figure 2:
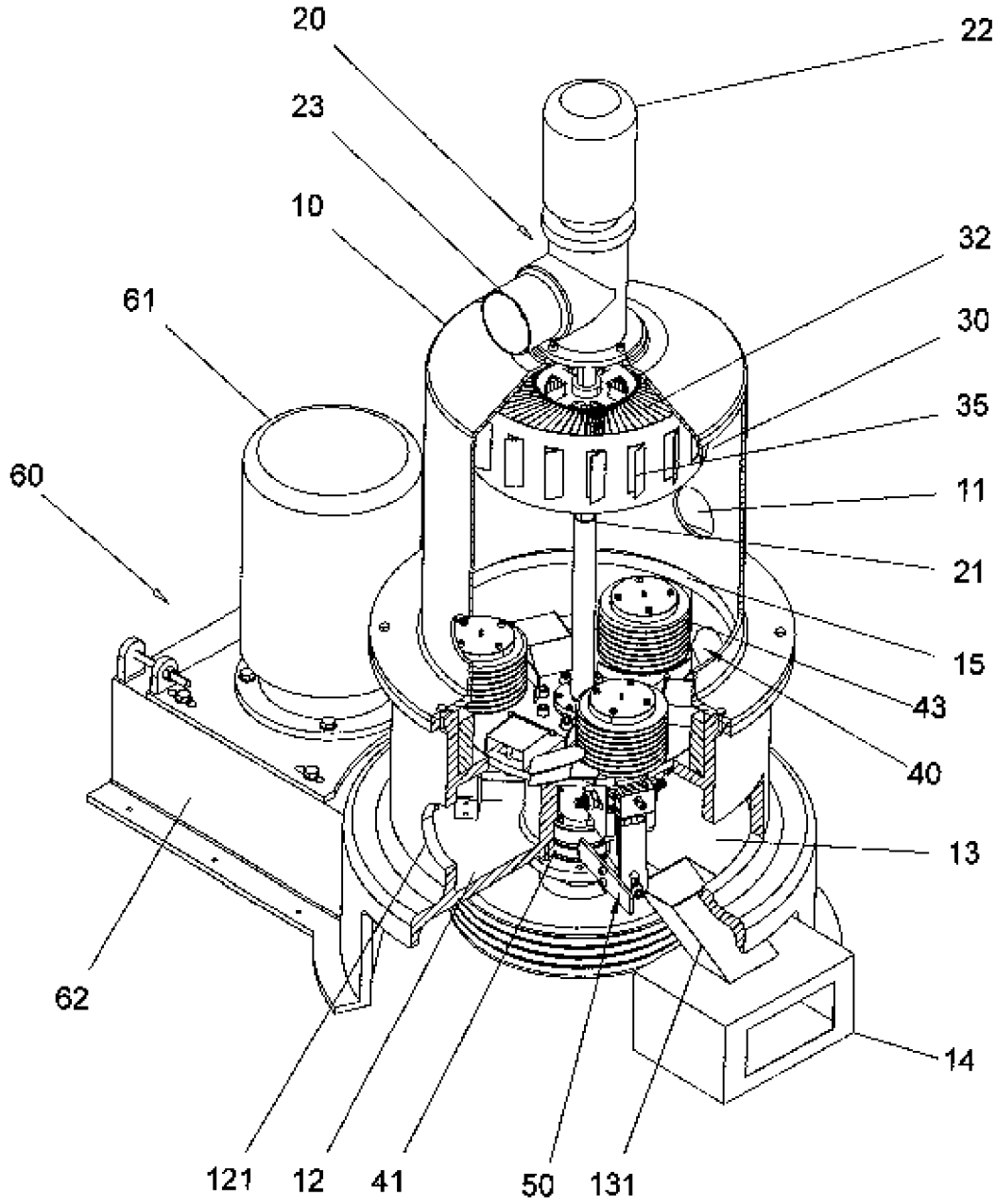
FIG. 2 is a partial sectional view of an embodiment of the grinding mill of the present invention with the guiding assembly assembled.

As shown in FIGS. 1-3 and 4A, the grinding mill of the present invention mainly comprises: a main body 10, accommodating structural parts for grinding; a suction assembly 20, connected with a collecting apparatus 71 for collecting ground products; a separator 30, separating ground products according to sizes thereof; a grinding device 40; several regulating devices 50; and a driving device 60.

The suction assembly 20 is placed on an upper end of the main body 10. The separator 30, the grinding device 40 and the regulating devices 50 are housed inside the main body 10. A feeding hole 11 connected to a feeding apparatus 70 is cut into the main body 10, providing raw material to be ground. The main body 10 further has a lower end with a resupplying chamber 12. The resupplying chamber 12 has a resupplying hole 121 which via a resupplying tube 72 lakes in excess air from the collecting apparatus 71, which is subsequently led back into the main body 10. A draining chamber 13 is placed at the lower end of the main body 10. A draining tube 131 leads from the draining chamber 13 to a waste chamber 14 where non-grindable components and waste from die grinding process are collected.

The suction assembly 20 has an upper end with a motor sleeve, a lower end which is connected with the upper end of die main body 10 and an inner space which accommodates a high-speed separator motor 22 and a separator shaft 21 that vertically reaches downwards. A frequency controller controls a centrifugal force of a separator movement around the separator shaft 21 that is needed for appropriate separation. The separator 30 has a guiding assembly 340, which allows precisely to regulate a degree of coarseness of separated particles. A suction tube 23 leads laterally away from the suction assembly 20 into a fan apparatus 73, that particles separated by the separator 30 are sucked out of the main body 10.

Figure 3:
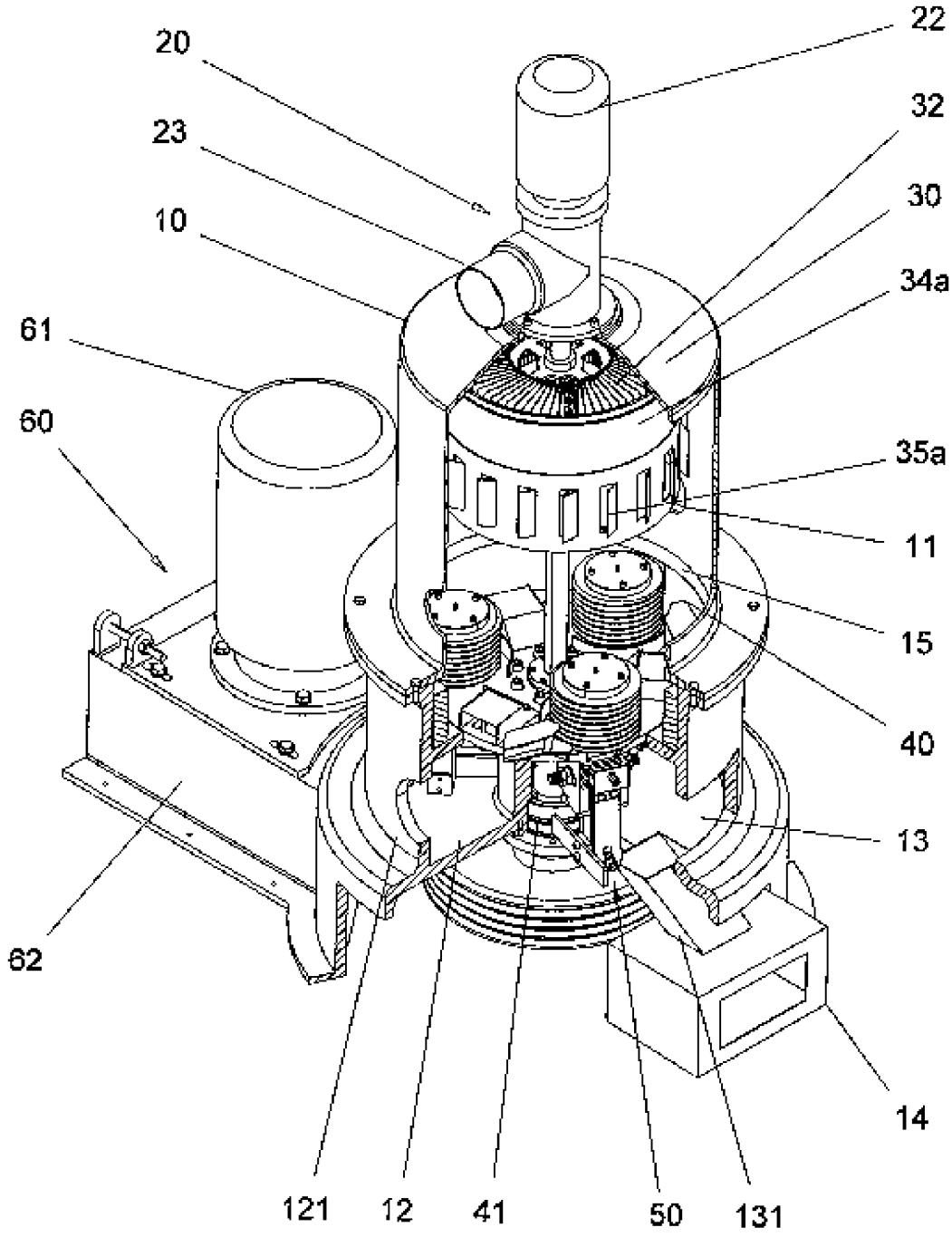
FIG. 3 is a partial sectional view of the grinding mill of the present invention with the guiding assembly assembled in another embodiment.
Figure 4:
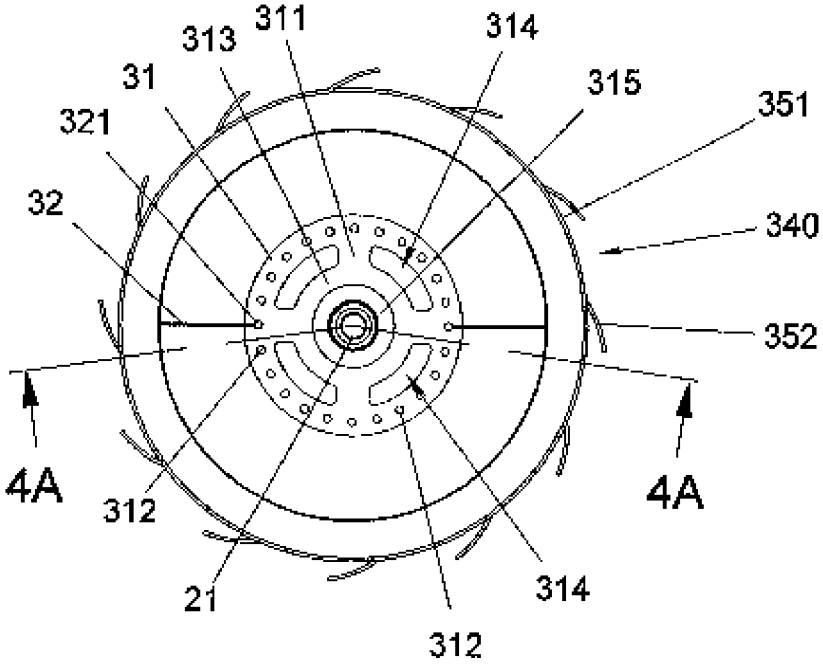
FIG. 4 is a lop view of the separator and the guiding assembly of the present invention.

Referring to FIGS. 1-4A, the separator 30 is mounted on a top end of the separator shaft 21 inside the main body 10, having two support rings 31 at upper and lower vertical positions and in parallel orientations. Each of the support rings 31 has a peripheral ring and an inner ring 313 of a relatively small diameter, connected to the peripheral ring by several radial bridges 311, between which curved openings 314 are left, as shown in FIG. 4. A plurality of mounting boles 312 are bored into the peripheral ring. A plurality of vertical blades 32 extends outward from the peripheral rings of the two support rings 31, fastened in the mounting holes 312 by vertical rods 321.

Figure 4A:
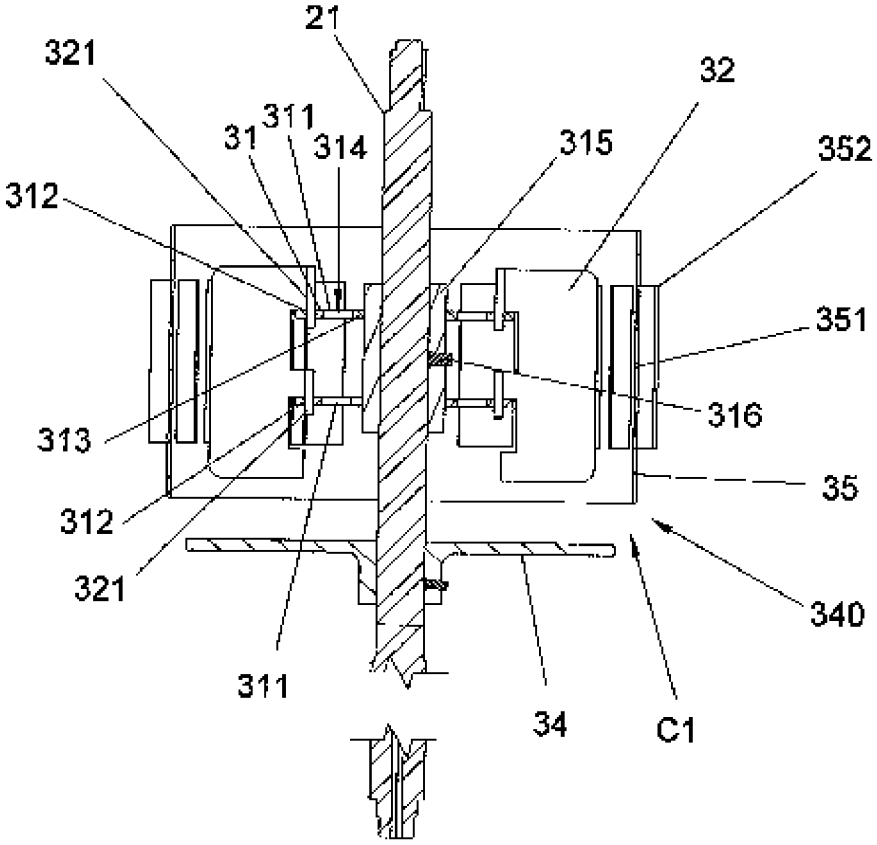
FIG. 4A is a sectional view of the separator and the guiding assembly of the present invention.

As shown in FIGS. 4 and 4A, for each of the support rings 31, the inner ring 313 is connected with a shaft sleeve 315, which in turn is fixed on the shaft 21. The curved openings 314 of the support rings 31 are aligned, so that canals for air flow, generated by the suction device 20, are formed. Relatively small particles pass through the curved openings 314, whereas relatively large particles are deflected by the blades 32 and fall back into the grinding device 40 to be ground again.

The main characteristic of the present invention is that the support rings 31 have parallel orientations and, for each of the support rings 31, the peripheral ring and the inner ring 313 are connected by the bridges 311, so that air flow generated by the suction assembly 20 proceeds unhindered, without interference by blades. Hence effectiveness of separating particles is greatly increased.

Furthermore, the blades 32, being mounted in the mounting holes 312 and held by vertical rods 321 as hinges, during operation in a normal state point radially outward due to a centrifugal force during rotation of the shaft 21. When, however, hit by large particles or clumps of grinding material each of the blades 32 turns aside, deflecting impacts and avoiding being damaged.

Figure 4B:
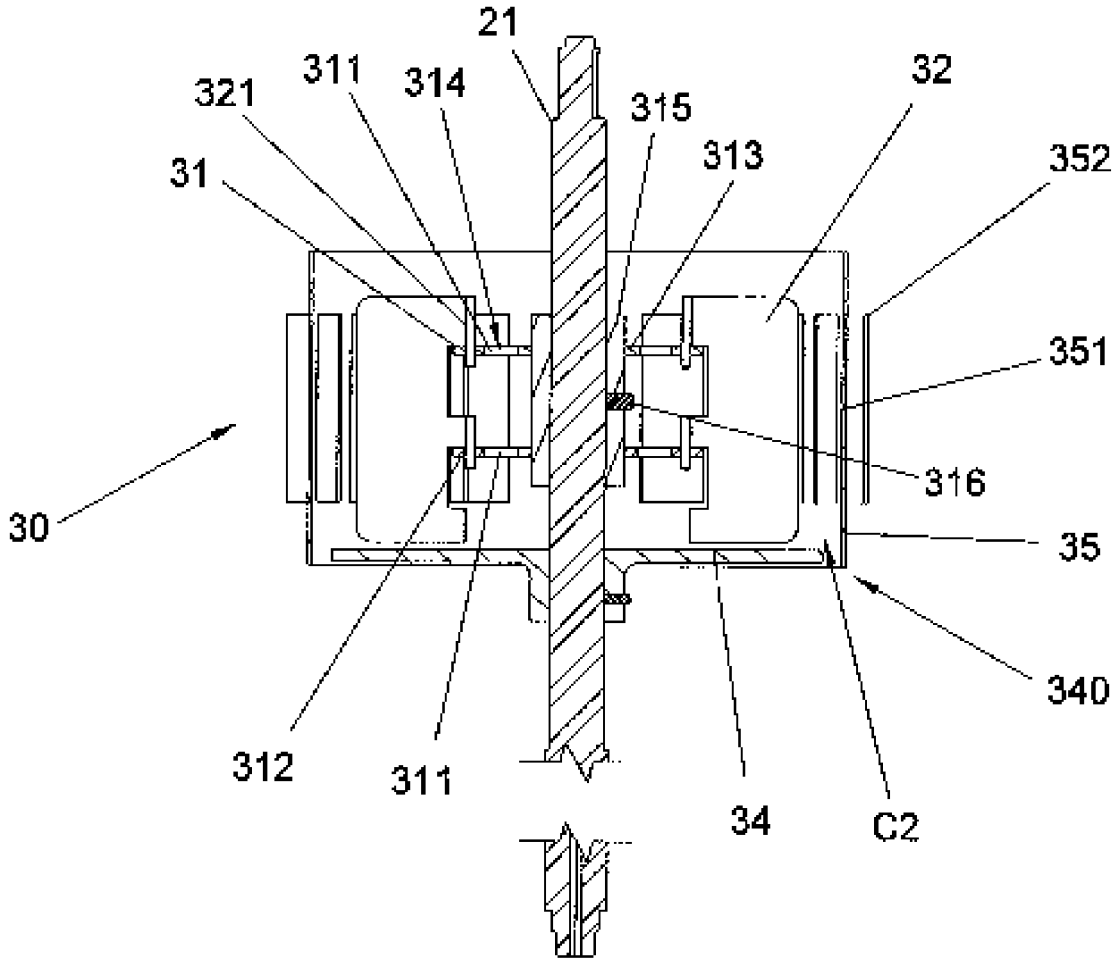
FIG. 4B is a sectional view of the separator and the guiding assembly of the present invention, indicating adjusting of the gap between the circular pan of the guiding assembly and the separator.

Referring now to FIGS. 2-5 , the guiding assembly 340 is placed on a periphery of the separator 30 inside the main body 10 on an upper part thereof. The guiding assembly 340 comprises a drum body 35 and a circular pan 34 with an outer diameter which is slightly smaller than the inner diameter of the drum body 35, with a gap CI remaining in between. The circular pan 34 is mounted on the shaft 21 by a pan vertical position adjusting device, which may be a fixing screw as shown in FIG.4A. As shown in FIG. 4B, for fine grinding, the vertical position of the circular pan 34 is adjusted relatively high, resulting in a small gap to the drum body 35 (indicated by C2). By adjusting the vertical position of the circular pan 34, air flow and excentric components thereof are controlled. For smaller particles passing through the separator 30, the gap C2 is adjusted to be smaller. Hence fineness of grinding is controllable.

Modifying a vertical position of the blades 32 on the support rings 31 allows to control fineness of grinding, too. As shown in FIG. 4A, the shaft sleeve 315 is fixed on the shaft 21 by a blade vertical position adjusting device which may also be a fixing screw 316 at a desired vertical position according to a desired vertical position of the blades 32. For coarser grinding, the blades 32 are lowered, so that grinding material bypasses the blades 32 more easily. For finer grinding, the blades 32 are raised, so that larger particles of grinding material are more likely to be hit by the blades 32.

The drum body 35 of the guiding assembly 340 has a periphery with a plurality of openings 351, each of which is partly covered by an inclined lid 352. Relatively large particles, which are accelerated outward by the centrifugal force during rotation of the shaft 21, bypass the inclined lids 352, hit an inner surface of the main body 10 and fall down to be grinded anew, whereas relatively small particles are kept within the drum body 35, rising along the air flow. The arrangement with the inclined lids 352 is adapted to the air flow and allows separation of even tiny particles according to size. Thus more effective separating of ground particles according to sizes thereof is achieved.

Figure 5:
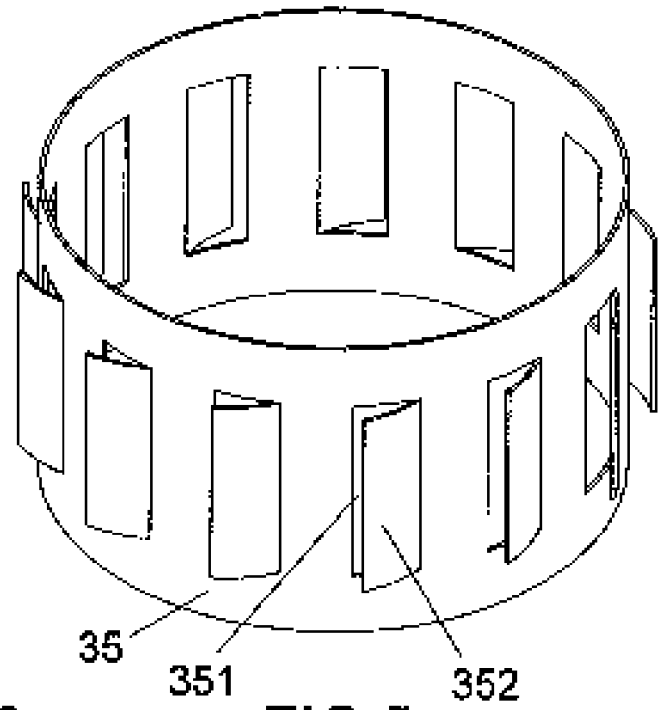
FIG. 5 is a perspective views of the drum body of the guiding assembly in the first embodiment.
Figure 5A:
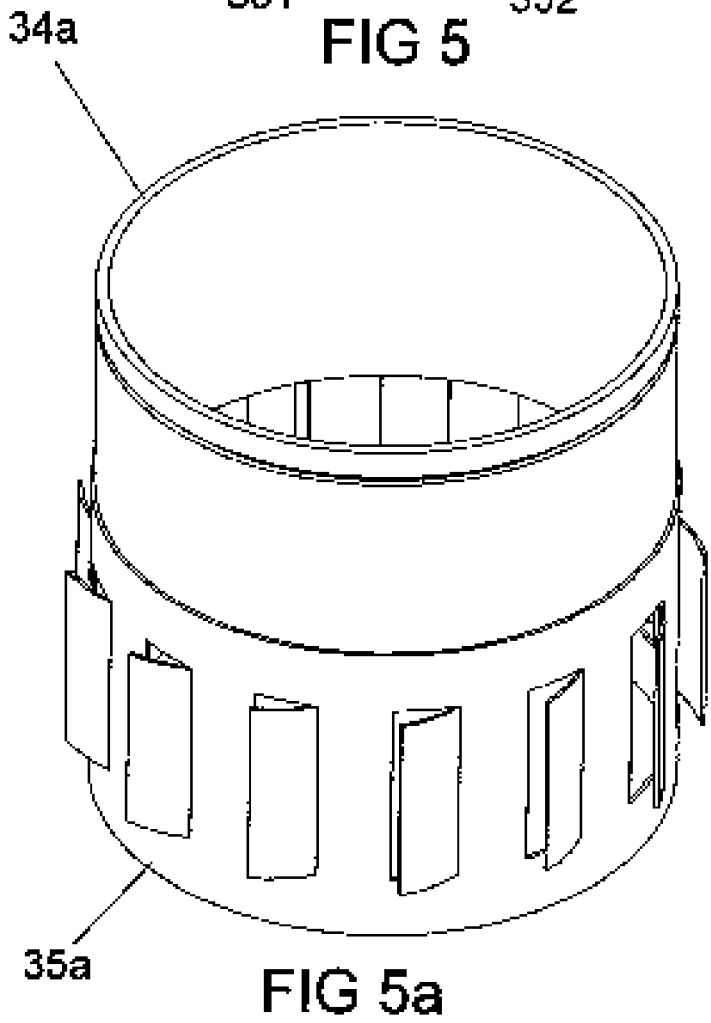
FIG. 5A is a perspective views of the drum body of the guiding assembly in the first embodiment, having an extension ring.

Referring again to FIGS. 3 and 5*a*, in an embodiment of the present invention, a drum body 35*a* is used having an upper edge with a vertically adjustable extension ring 34*a* , providing additional space for separating larger particles through the blades 32.

Figure 5B:
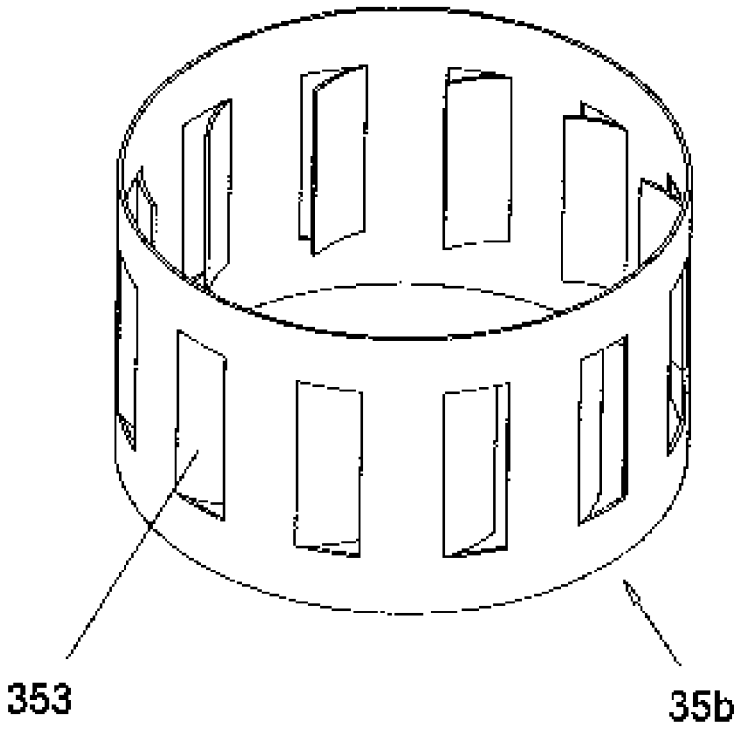
FIG. 5B is a perspective views of the drum body of the guiding assembly in the second embodiment.
Figure 5C:
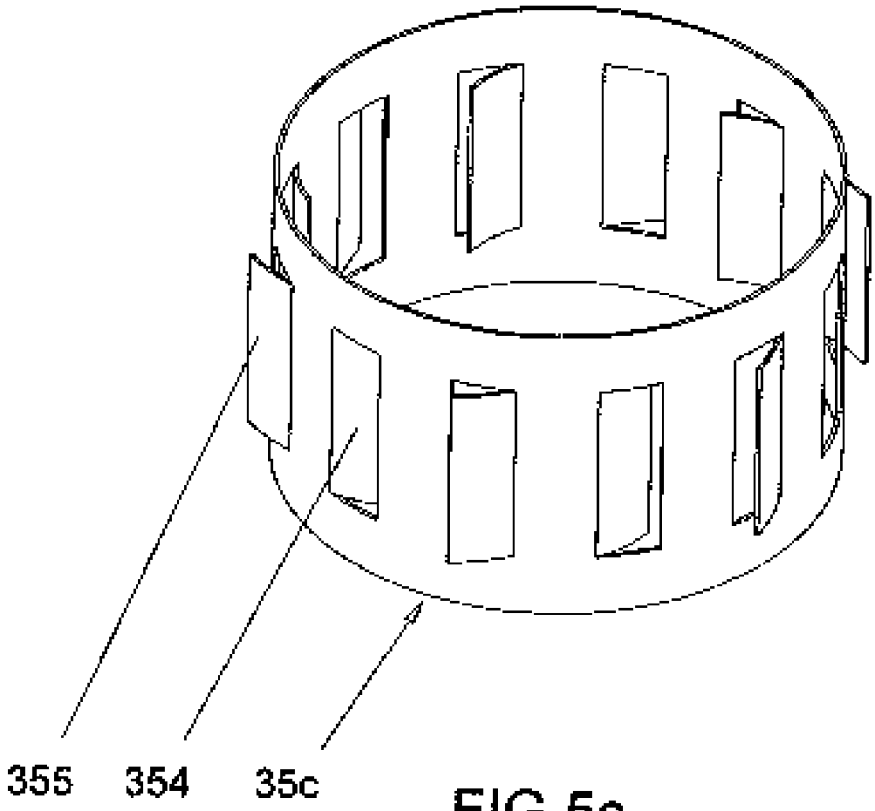
FIG. 5C is a perspective views of the drum body of the guiding assembly in the third embodiment.
Figure 6:
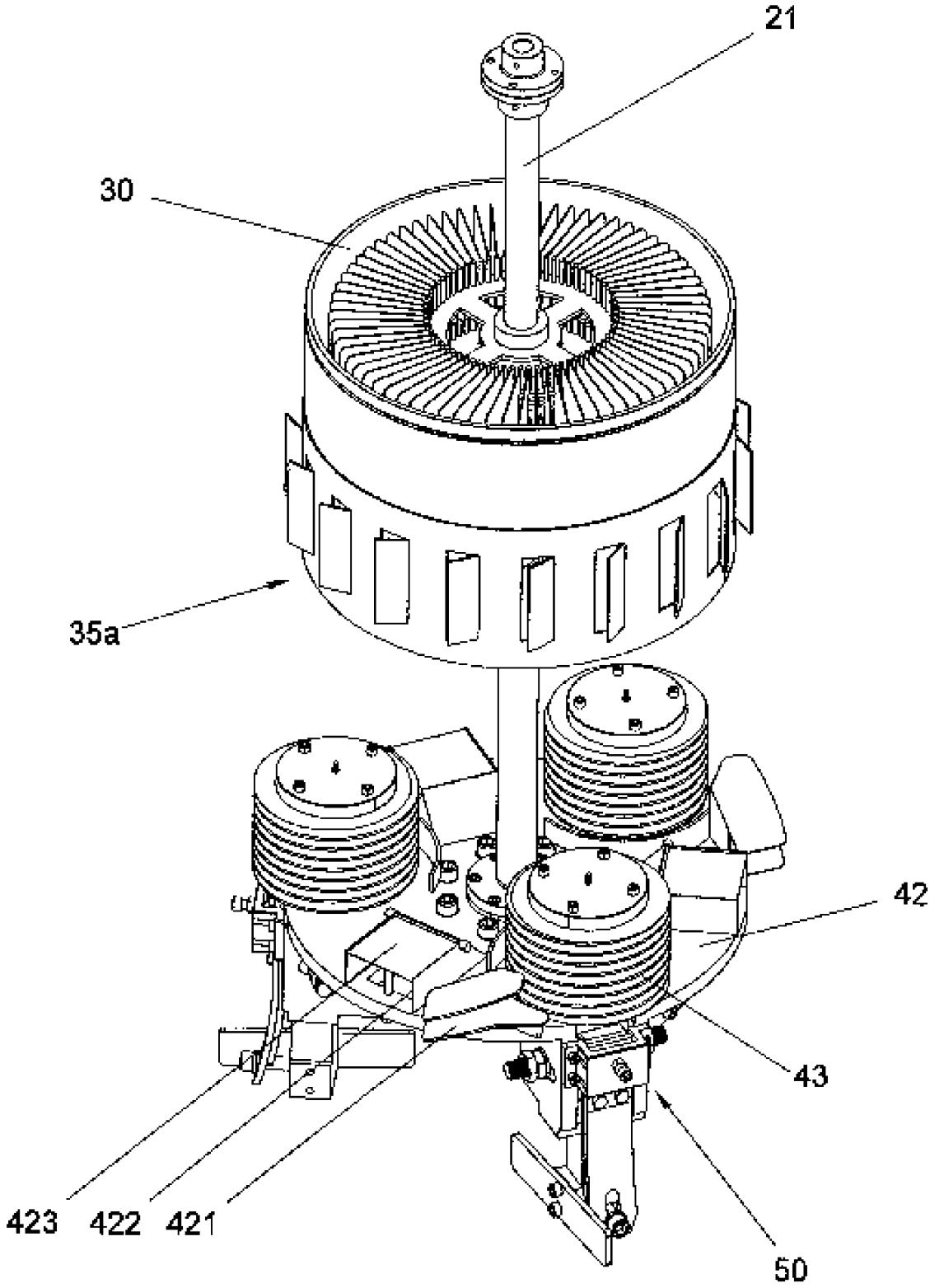
FIG. 6 is a perspective view of the separator and the grinding device of the present invention.
Figure 7:
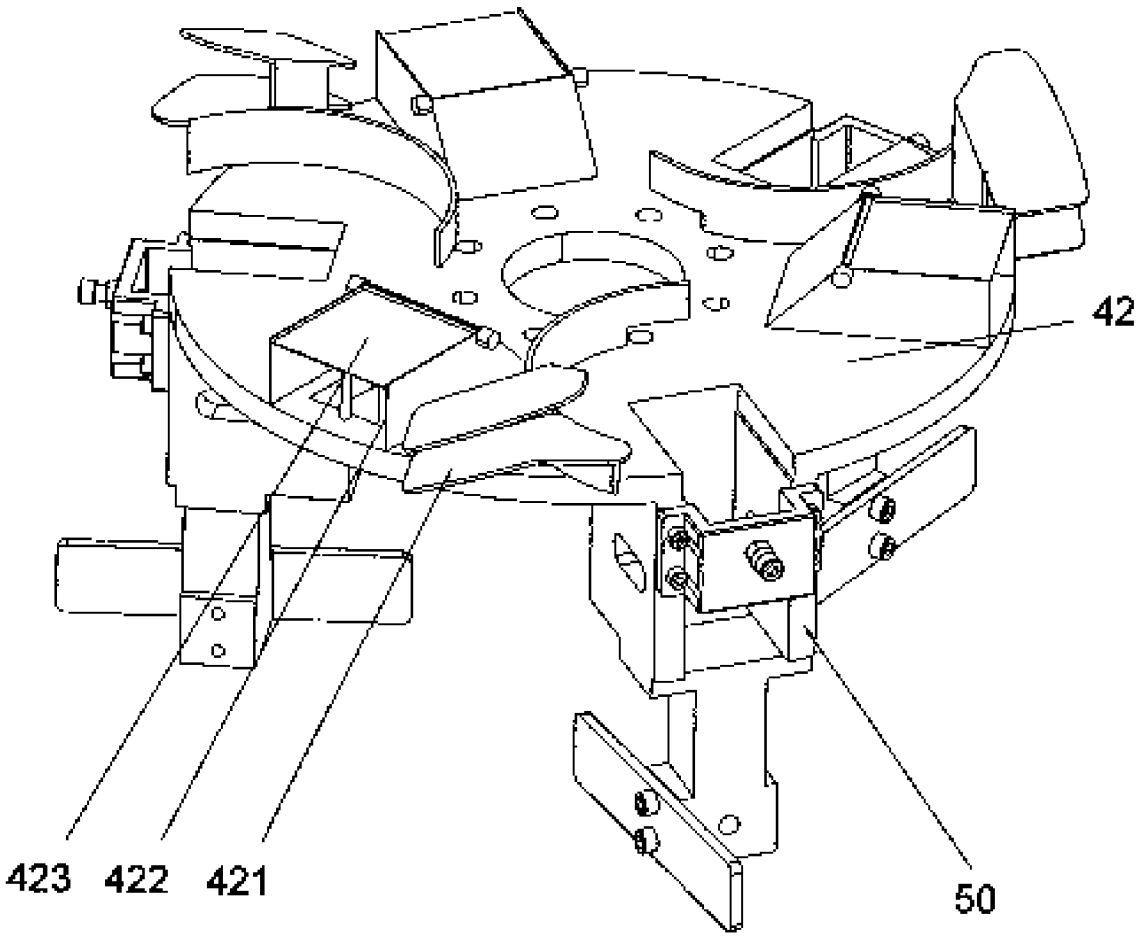
FIG. 7 is a perspective view of an excentric disc of the present embodiment.
Figure 8:
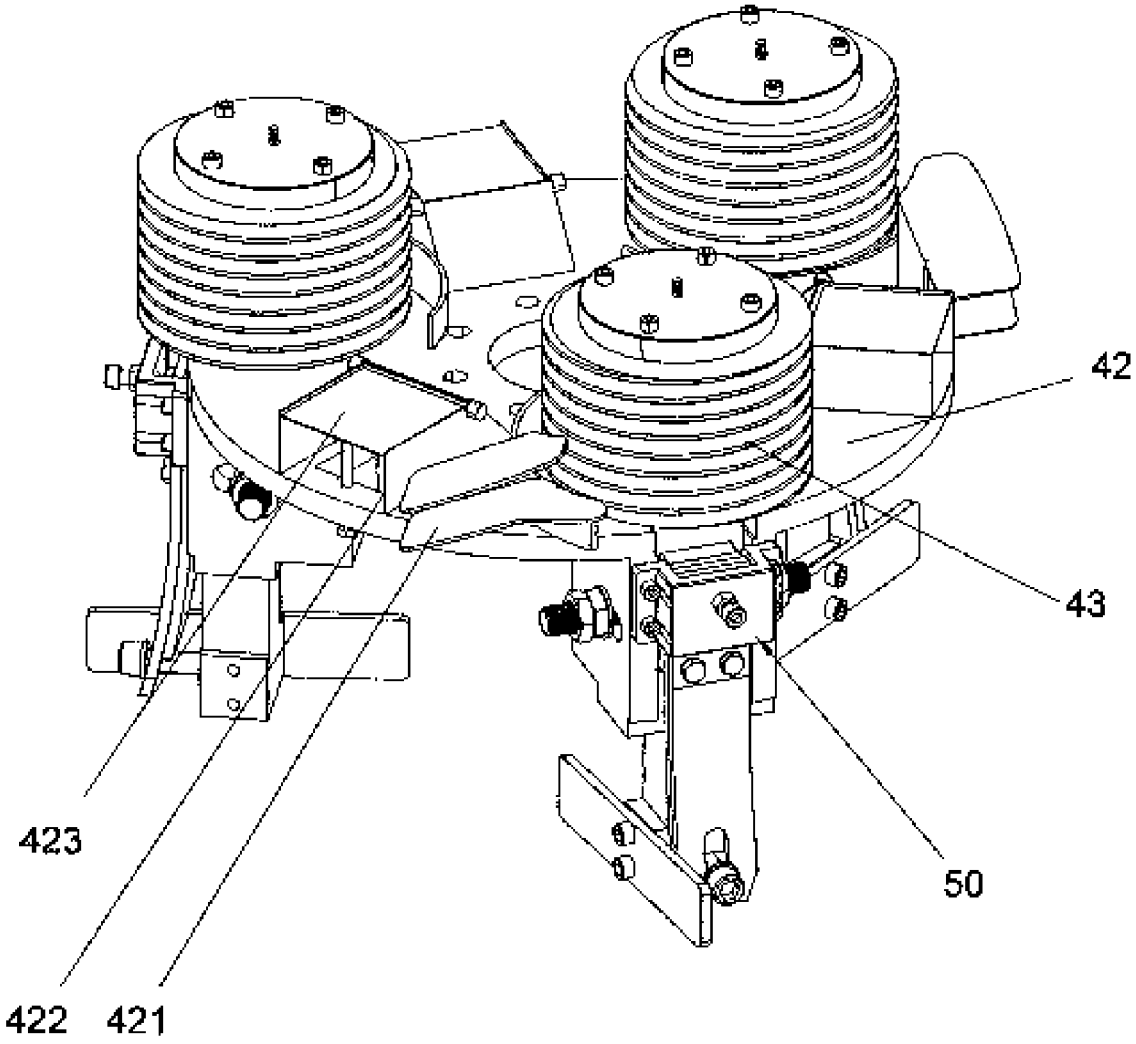
FIG. 8 is a perspective view of the excentric disc with the grinding wheels mounted.
Figure 9:
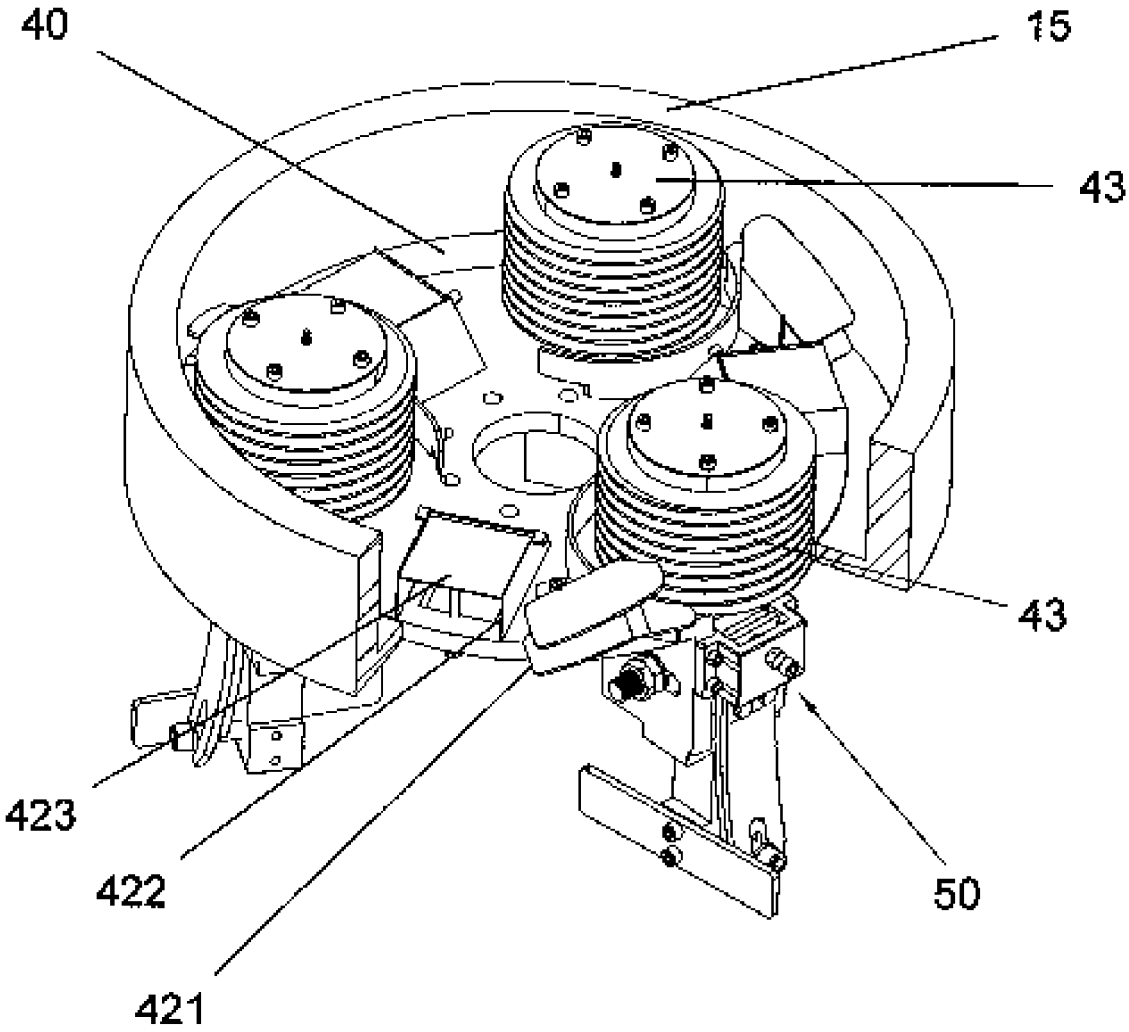
FIG. 9 is a perspective view of a grinding device of the present invention.
Figure 10:
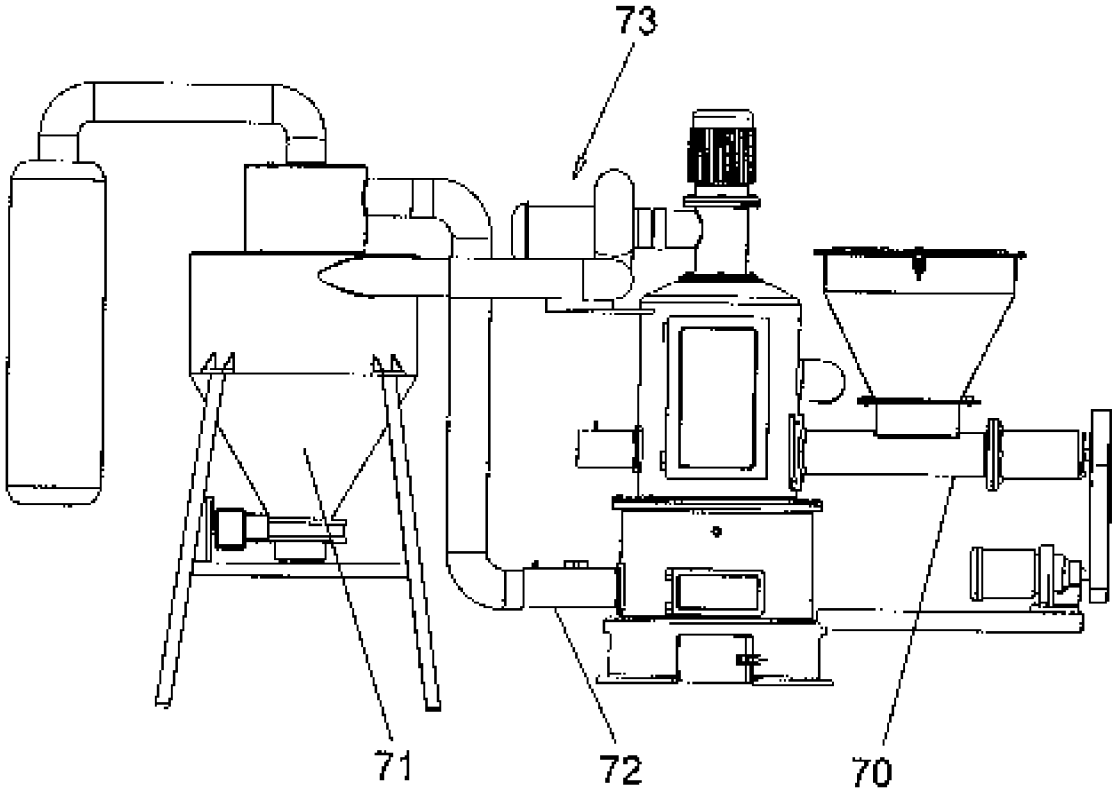
FIG. 10 is a schematic illustration of the air flow in the present invention.
Figure 11:
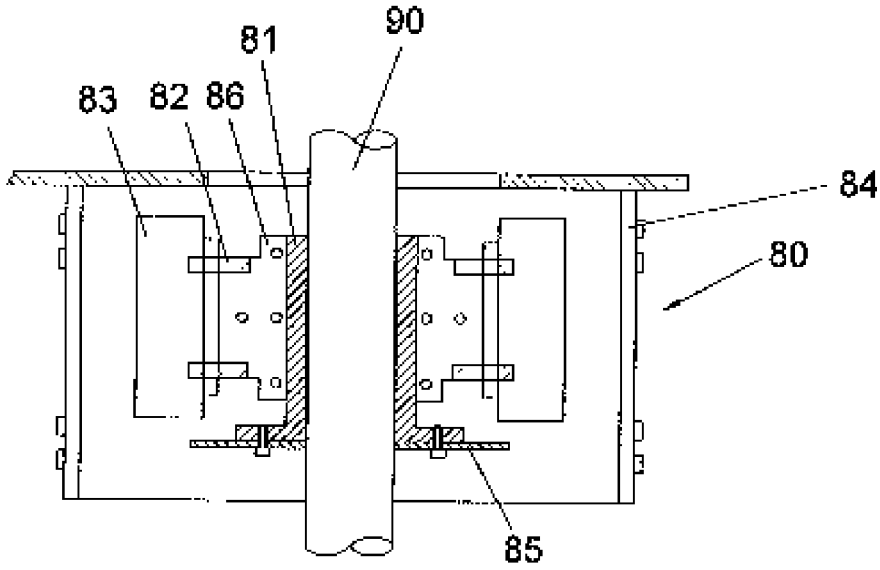
PRIOR ART FIG 11
FIG. 11 (prior art) is a side view of the separator of U.S. Pat. No. 5,238,196.
Figure 12:
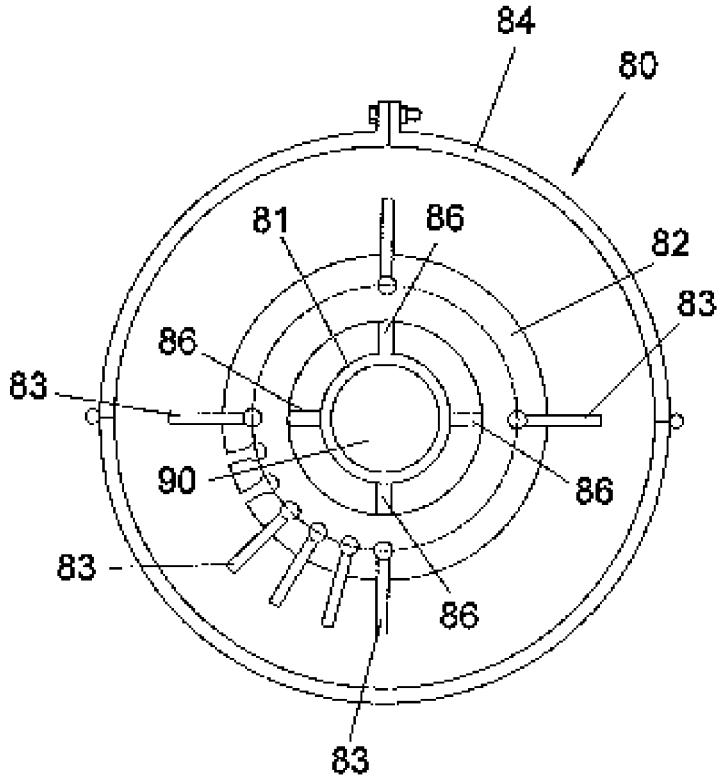
PRIOR ART FIG 12
FIG. 12 (prior art) is a top view of the separator of U.S. Pat. No. 5,238,196.

Referring to FIGS. 3 and 5*b*, in another embodiment of the present invention, a drum body 35*b* is used having lids 353 that are inclined inwards. As shown in FIG. 5*c*, in a further embodiment of the present invention, a drum body 35*c* is used having lids 354, 355 that are alternatingly inclined inwards and outwards for adjusting to the air flow carrying particles.

Referring now to FIGS. 1 and 6-10, the grinding device 40 is placed inside the main body 10, surrounded by a grinding ring 15. The grinding device 40 has a main axis 41 which is driven by the driving device 60 to perform a rotational grinding movement. An eccentric disc 42 is set on the main axis 41, carrying a plurality of grinding wheels 43 arranged to have suitable distances to the grinding ring 15. Ramps 421, each placed next to one of the grinding wheels 43 on the excentric disc 42, guide raw material into two vertical sections between the grinding wheels 43 and the grinding ring 15, preventing accumulation thereof. Furthermore, air inlets 422 are placed on the excentric disc 42, covered by hinged lids 423. The lids 423 freely open in the airflow that is driven by the fan apparatus 73.

The driving device 60 has a main motor 61 which drives the grinding device 40. The main motor 61 extends into a casing 62, driving the grinding movement of the main axis 41. A gearbox is accommodated by the casing 62, allowing for high, middle and low speeds of the grinding movement according to raw material for optimum throughput.

For operating the grinding mill of the present invention, first the separator motor 22, then the main motor 61 are turned on. Consequently, the main axis 41 and the excentric disc 42 perform the grinding movement, causing the grinding wheels 43 to revolve inside of the grinding ring 15, performing the grinding process.

After switching on the fan apparatus 73, air enters the main body 10 through the resupplying tube 72 and the resupplying hole 121 and is sucked upwards through the air inlets 422. At the same time, raw material enters the main body 10 through the feeding hole 11. Entering raw material is not carried away by air flow due to large particle sizes and rather falls directly on the excentric disc 42 within the grinding ring 15. The rotating grinding movement of the excentric disc 42 causes raw material to be led along the ramps 421 on two vertical sections between the grinding wheels 43 and the grinding ring 15 and to be ground. Ground material rises with the air flow, entering the separator 30, and is separated there, with smaller particles being carried away to the suction tube 23 and larger particles falling back into the main body 10. Outflowing air is recycled into the main body 10 through the resupplying hole 121 and the air inlet 422, preventing raw material from accumulating.

While the invention has been described with reference to preferred embodiments thereof, it is to be understood dial modifications or variations may be easily made without departing from the spirit of this invention which is defined by the appended claims.

The invention claimed is:

1. A separator for use in conjunction with a grinding mill and mounted in a main body thereof on a rotating vertical separator shaft, comprising:

two support rings of equal sizes and shapes, mounted in parallel orientations concentrically around said separator shaft on a shaft sleeve, each of said two support rings connected to said shaft sleeve by radial bridges, so that openings are formed, with said openings of said two support rings being aligned; and a plurality of blades, each mounted on peripheries of said two support rings ; wherein, for each of said two support rings, said openings are surrounded by a plurality of mounting holes and each of said plurality of blades is hingedly mounted on one mounting hole of each of said two support rings by a vertical rod.

2. The separator according to claim 1, wherein said shaft sleeve is mounted on said separator shaft by a blade vertical position adjusting device on said separator shaft.

3. The separator according to claim 1, wherein said blade vertical position adjusting device is a fixing screw.

4. The separator according to claim 1, wherein said separator further comprises a guiding assembly, having a drum body and a circular pan, said drum body having a peripheral surface with a plurality of openings, which are covered by inclined lids fixed to one edge, and said circular pan being mounted on said separator shaft below said drum body by a pan vertical position adjusting device.

5. The separator according to claim 1, wherein said separator further comprises a guiding assembly, having a drum body and a circular pan, said drum body having a peripheral surface with a plurality of openings, which are covered by inclined lids fixed to one edge, and said circular pan being mounted below said drum body at a vertically adjustable distance by a pan vertical position adjusting device.

6. The separator according to claim 2, wherein said separator further comprises a guiding assembly, having a drum body and a circular pan, said drum body having a peripheral surface with a plurality of openings, which are covered by inclined lids fixed to one edge, and said circular pan being mounted below said drum body by a pan vertical position adjusting device at a vertically adjustable distance.

7. The separator according to claim 3, wherein said separator further comprises a guiding assembly, having a drum body and a circular pan, said drum body having a peripheral surface with a plurality of openings, which are covered by inclined lids fixed to one edge, and said circular pan being mounted below said drum body at a vertically adjustable distance by a pan vertical position adjusting device.

8. The separator according to claim 4, wherein said inclined lids point outwards.

9. The separator according to claim 4, wherein said inclined lids point inwards.

10. The separator according to claim 4, wherein said inclined lids point partly inwards and partly outwards.

11. The separator according to claim 4, wherein a vertically adjustable extension ring is attached to an upper side of said drum body.

* * * * *